United States Patent [19]

Bruniaux

[11] 4,000,555

[45] Jan. 4, 1977

[54] PROCESS FOR PRODUCING STRAW-BOTTOMED CHAIRS

[76] Inventor: Pierre Bruniaux, 8, rue des Bouchers, Cambrai (Nord), France

[22] Filed: Nov. 26, 1974

[21] Appl. No.: 527,511

[30] Foreign Application Priority Data

| | | |
|---|---|---|
| Nov. 30, 1973 | France | 73.42900 |
| July 16, 1974 | France | 74.24751 |
| Nov. 13, 1974 | France | 74.37452 |

[52] U.S. Cl. ..... 29/417; 29/418; 160/371; 160/378; 297/452

[51] Int. Cl.[2] ..... B23P 17/04

[58] Field of Search ..... 29/417, 418, 163.5 F, 29/91.1, 91.5; 297/452; 160/327, 371, 378

[56] References Cited

UNITED STATES PATENTS

| | | | |
|---|---|---|---|
| 714,730 | 12/1902 | Morris | 160/378 |
| 719,601 | 2/1903 | Morris | 160/371 |
| 1,075,500 | 10/1913 | Schmits | 160/378 |
| 3,266,122 | 8/1966 | O'Kane et al. | 29/417 X |
| 3,606,462 | 9/1971 | Bruniaux | 297/452 |

FOREIGN PATENTS OR APPLICATIONS

| | | | |
|---|---|---|---|
| 408,751 | 2/1910 | France | 160/371 |
| 803,597 | 7/1936 | France | 160/371 |
| 1,090,773 | 11/1967 | United Kingdom | 297/452 |

*Primary Examiner*—Victor A. DiPalma
*Attorney, Agent, or Firm*—Seidel, Gonda & Goldhammer

[57] ABSTRACT

A process for producing straw-bottomed chairs, wherein the fabric intended for making the seat thereof is woven by imitating a straw-bottom of chair, and the element thus woven is tensioned onto a framework or a plate corresponding to the shape of the seat, the sheet being woven in continuous and constituted by several elements which are cut after weaving.

6 Claims, 9 Drawing Figures

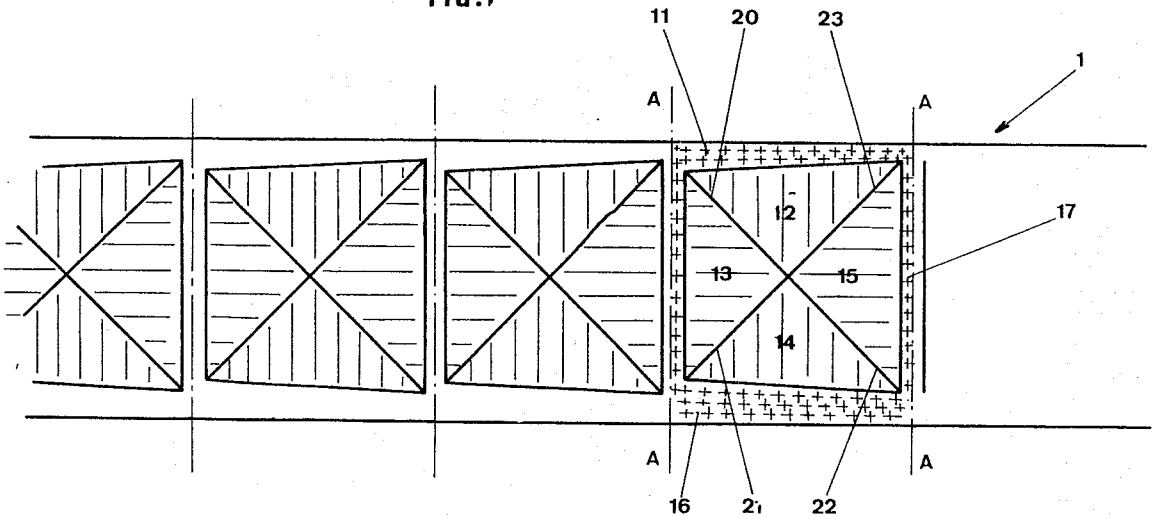
FIG.1
FIG.2
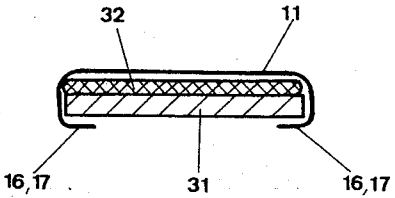
FIG.3

PROCESS FOR PRODUCING STRAW-BOTTOMED CHAIRS

The present invention relates to a process for producing straw-bottomed chairs as well as the chairs made through said process.

The seats called "traditional" are more and more popular. Among said seats, there are especially the chairs called "straw-bottomed chairs". However, manufacturing said chairs according to standard craftship processes has a certain number of drawbacks particularly in the cost.

As a matter of fact, workmen qualified for making straw-bottomed chairs become rarer and rarer indeed. On the other hand, making straw-bottomed chairs according to the standard way requires a rather long time, which results in a high price.

Several solutions were already suggested in order to remedy these drawbacks.

The purpose of the present invention is to provide a process for the manufacture of straw-bottomed chairs, which allows mass production thereof, while still producing chairs having the same look as those produced by craftsmen.

To this end, the invention relates to a process for manufacturing straw-bottomed chairs, wherein there is a fabric constituting the seat which is woven, and which looks like the straw-bottom of a chair, and the element thus woven is tensioned on to either a framework or a plate corresponding to the shape of the seat.

According to another characteristic of the invention, the surface of a seat is simultaneously woven by means of a thread of straw or any other similar material, at the same time threads for maintaining the straw-bottom are inserted therein, said fixing threads constituting ornamental elements or removable elements after the woven straw is secured to the seat.

According to another characteristic of the invention, the straw fabric is woven by means of threads of straw or any other elements looking like straw, a process wherein the threads of straw are secured onto a texture woven in such a way that they divide the straw-bottom into sections.

According to a characteristic of the invention, the straw-bottomed chair comprises a plate consisting of a framework serving as a support, on which a woven element is tensioned, woven in such a way that it looks like the straw-bottom of a chair.

According to another characteristic of the invention, the woven straw-bottom element includes fastening elements at its edges, such as a tape provided with eyelets enabling the straw surface element to be secured to the chair, particularly by means of strings.

According to another characteristic of the invention, the straw-bottomed element includes a net like fabric serving as a covering canvas as well as a support for the straw.

The present invention will be described with more details by means of the attached drawings, in which:

FIG. 1 is a diagrammatical view from above of a mode of embodiment of a woven mat;

FIG. 2 is a cross-section view of the fitting of a portion of the mat to a framework so as to constitute a seat;

FIG. 3 is a cross-section view of another fitting of the woven mat to a framework;

Figure 4:
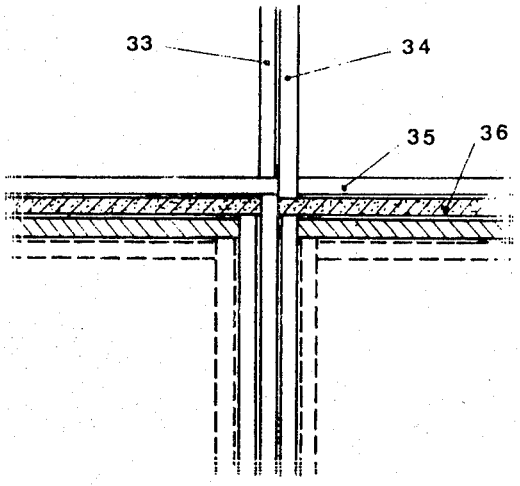
FIG. 4 is a diagrammatical view of a method for making the straw-bottom of a chair.

As shown in FIG. 1, the process depicted therein consists in weaving a continuous tape 1 comprising a plurality of elements 11, separated from each other by dashed lines A-A. Each element 11 has a shape, for example, trapezoidal-shaped, and comprises four triangles 12, not necessarily equal to each other, 13, 14, 15, which have the same look as the straw-bottom of a chair.

Said elements 12, 13, 14, 15 are provided with a rim 16, 17.

The tape 1, consisting of the elements 11, is for example woven by means of a machine such as a Jacquard machine, and by using a thread whose size corresponds to that of the stem of genuine straw, used for making straw-bottoms of chairs.

The rims 16, 17 of the elements 11 are, preferably, woven, that is to say, constituted by interlocking of weft and warp threads. On the other hand, in order to imitate as much as possible the structure of a straw-bottomed chair, the warp threads are not woven in the portions 13 and 15. In the same way, the weft threads are not woven in the portions 12 and 14.

As diagrammatically shown, in the portions 13 and 15, the warp threads overlap the weft threads, while in the portions 12 and 14, the weft threads overlap the warp threads.

So as to fix the relative position of the weft and warp threads, particularly at the level of the junction lines 20, 21, 22, 23, formed by the contiguous sides of the portions 12, 13, 14, 15, it may be interesting to weave very few warp and weft threads at the level of lines 20, 21, 22, 23. This enables, not only to fix the threads of the elements 12, 13, 14, 15, but also to improve the aesthetic aspect.

According to a variant not shown, in case the threads woven would be made of a heat-synthetic material, it may be advantageous to form the lines 20, 21, 22, 23, through a single heat die-casting, which shows the advantage of welding the threads at the same level as that of said die-casting lines.

According to another variant, it is possible to glue or otherwise stick the threads together on a level with the lines 20, 21, 22, 23.

According to the process subject matter of the invention, it is of great advantage to achieve a tape 1 rather long, comprising a plurality of elements 11, separated from each other by woven zones 17. However, it is also possible to weave each element 11 separately, as stated hereabove.

After having woven the elements 11 separately, or having cut them from the continuous tape 1, one can then proceed to the manufacture of the plate of the seat such as shown in FIGS. 2 and 3.

According to a first mode of embodiment shown in FIG. 2, an element 11 is tensioned on a frame 30 constituting the support of the plate. Said element 11 is fixed thereto by its edges with fasteners, nails, glue or any other fixing means.

Under these conditions, the peripheral zone 16, 17, which is woven and allows a more efficient fastening than the portions 12, 13, 14, 15 which consist of threads parallel and not linked to each other, is advantageously used.

FIG. 3 shows a variant of a mode of embodiment of a plate for a straw-bottomed chair.

According to this mode of embodiment, a solid plate 31 is used and covered first with a stuffing layer 32, and afterwards the element 11 is tensioned on said plate by fixing the edges 16, 17 of the element 11 beneath the lower face of the plate 31.

According to another mode of embodiment not shown, particularly when plates of stuffed seats are used, it is possible to make the stuffing element 32 in several portions having the same shape as that of the portions 13, 14, 15 of the pattern of the strawed element.

In that way, the stuffing elements will be first fixed on the plate 31, and then covered by means of the element 11.

In order to improve the aspect of the straw-bottomed seat and more faithfully reproduce the convex shape of the triangles 12, 13, 14, 15 of a genuine straw-bottomed chair, it is quite possible to fix the element 11, not only to the periphery, beneath the plate 31, but also according to lines 20, 21, 22. 23.

The above description relates to elements 11 of a straw-bottomed chair, having the same looking as a standard straw-bottom.

However, it is quite possible to replace the triangles 12, 13, 14 and 15 with any other shapes to produce a fancy straw-bottom. To this end, it is but necessary to modify the programs of the loom used and, especially, that of the Jacquard one with which the elements 11 are made.

According to a variant not shown, the stuffing material is inserted between the weft and warp threads, so as to ensure a better shaping of the triangular portions of the straw-bottomed chair.

According to a variant, a genuine or synthetic straw thread is woven according to a defined pattern. At the same time, one or several fixing threads are woven, which appear either on the coating surface so as to form an ornamental drawing, or in order to only serve to maintain the threads until stuffing is performed. In this second case, the fixing threads are removed after the chair is stuffed or more generally after stuffing of the surface to be covered.

When the fixing threads only appear on the lower surface, that is to say when they do not appear on the outer surface, said fixing threads may be not removed after the chair is stuffed.

Another variant of the process consists in making a double weaving for maintaining the threads. Said double weaving, which maintains the threads of the weft and warp constituting the straw-bottom in position, does appear but on the unseen portion of the latter. Said double weaving also enables to insert a stuffing or to secure a stuffing on the lower surface of the sheet of straw.

For the purpose of the double weaving or the reinforcing threads, threads made of a synthetic material such as polyamide threads or furthermore a rope, can be used.

Finally, according to another variant of the process, the warp and weft threads constituting the woven surface can be stuck to each other or on a supporting surface allowing handling and carrying without the threads being seperated.

Another variant for making surfaces of straw-bottoms of chairs or furniture consists in performing said weaving by superposing successively the threads imitating genuine straw according to a certain order, in order to make out a determined pattern.

According to a first process used for making an X-shaped straw-bottom (consisting of triangular portions in which all the threads in each triangle are parallel), two close parallel threads are first put in position, then two threads parallel to each other are superposed, perpendicular to the direction of the two preceding ones. Said operation is repeated until the required surface is obtained, by, for example, starting at the center and finishing at the peripheral portion.

According to a variant of the process, the threads are superposed in turn in accordance with a spiral tracing.

In the first case relation to superposed woven threads, it may be advantageous to fix the central portion of the first group of two threads or of the first one, because the latter is not covered by any superposed thread.

Finally, the present improvement relates to another weaving process which may apply to any weaving imitating an X-shaped straw-bottom so as to avoid the central arm to freely move between these two ends, thus not requiring any binding.

To this end, the top of the triangles are offset as shown in FIG. 4. This Figure shows overlapping of two warp threads 33, 34 with two weft threads 35, 36 on a level with the center of the pattern of the X-shaped straw-bottom. Said overlapping shows that no thread is free.

Figure 5:
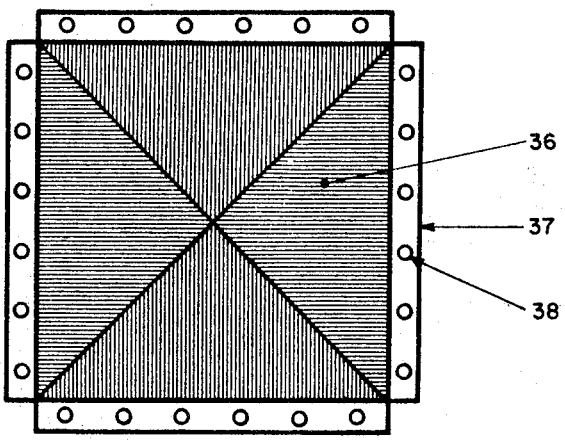
FIG. 5 is a plane view of a straw-bottom element provided with fastening means.

In FIG. 5, a straw-bottom element is shown, for example for a chair, but which could serve to cover a back of seat or, more generally any surface of a piece of furniture. Said straw-bottom element comprises a central portion 36, for example woven according to a pattern described above and whose four edges are provided with fastening means 37, such as tapes with eyelets 38. These fastening means serve firstly to maintain the threads of the woven straw-bottom 36 fixed and secondly, to make easier the positioning of such straw-bottom elements, for instance in order to cover a seat. As a matter of fact, it is but necessary to this end to link the various fastening means 37 together by means of strings passing through the eyelets. This enables easy tension of the straw-bottom element onto the seat. Also, the fastening tapes 37 could be textile tapes having no eyelets nor perforations, which would then facilitate fastening by means of fasteners on the lower surface of the edge of the seat.

Figure 6:
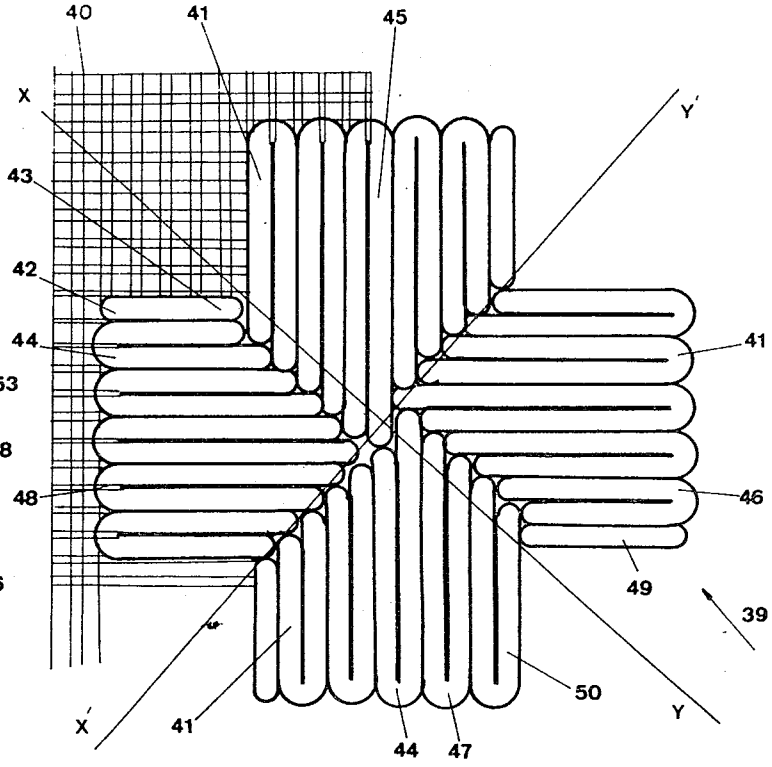
FIG. 6 is a partial view from above of a first embodiment of a straw fabric for a chair.

As shown in FIG. 6, the chair covering consisting of the straw-bottom element 39, is a first embodiment according to the invention. For making said straw-bottom 39, a weft 40 shown with fine lines is used. This weft 40 serves as a support onto which the straw-bottom threads 41 are secured. Said straw-bottom threads 41 are made of either a synthetic material or genuine straw.

The straw-bottom threads 41 are fixed onto the weft 40 from a starting point 42. Then, this thread is passed beneath the weft 40 at point 43 so as to form an invisible loop. This straw-bottom thread afterwards returns to the outside and then is passed beneath the weft 40 so as to form a loop 44. The straw-bottom threads 41 are fixed on the weft 40 so as to make four sections 45, 46, 47, 48, triangle-shaped. The straw-bottom threads 41 of a section are perpendicular to the straw-bottom ones 41 of and adjacent section.

The straw-bottom threads 41, the upper portion of which only is seen, are fixed onto the weft 40 so that the threads of the section 46 insert within the threads of the adjacent sections 45 and 47, according to two junction lines X-Y, X'-Y' cross-shaped. The straw-bottom threads 41 insert in each other so as to cross themselves and to superpose in turn along two junction lines X-Y and X'-Y'. Thus, for example, the thread 49 crosses the thread 50 and overlaps the latter in turn along the junction line X-Y.

Figure 7:
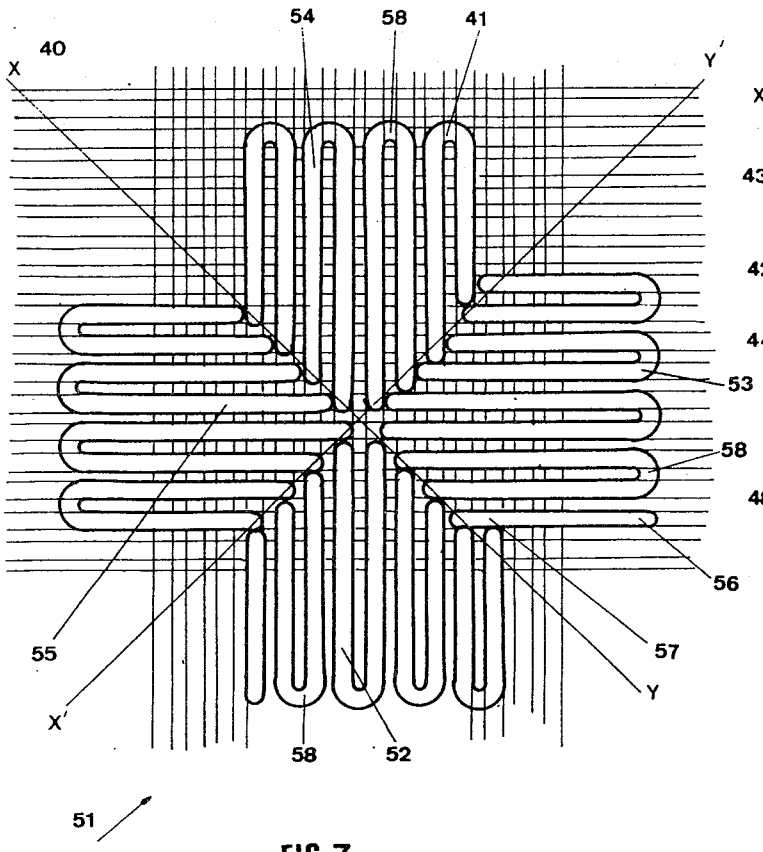
FIG. 7 is a partial view from above of a second embodiment of a straw fabric for a chair.

As shown in FIG. 7, the chair covering 51 constitutes a second embodiment of a covering for chairs, according to the invention.

Said covering 51 consists of straw-bottom threads 41 fixed onto a weft 40 in order to define four triangle-shaped sections 52, 53, 54 and 55. The straw-bottom threads 41 start, for example, from point 56, and make loops beneath the weft at 57 and 58. The loops 57 also pass beneath the weft 40 and are arranged along both junction lines X-Y and X'-Y' of the straw-bottom threads 41. According to this mode of embodiment, the straw-bottom threads are joined together along two junction lines X-Y and X'-Y', and form alternated loops without crossing or overlapping each other. The straw-bottom threads 41 of each portion 52, 53, 54 and 55 are joined together along two junction lines X-Y and X'-Y', perpendicular with respect to the straw-bottom thread 41 of the directly adjacent portions.

Figure 8:
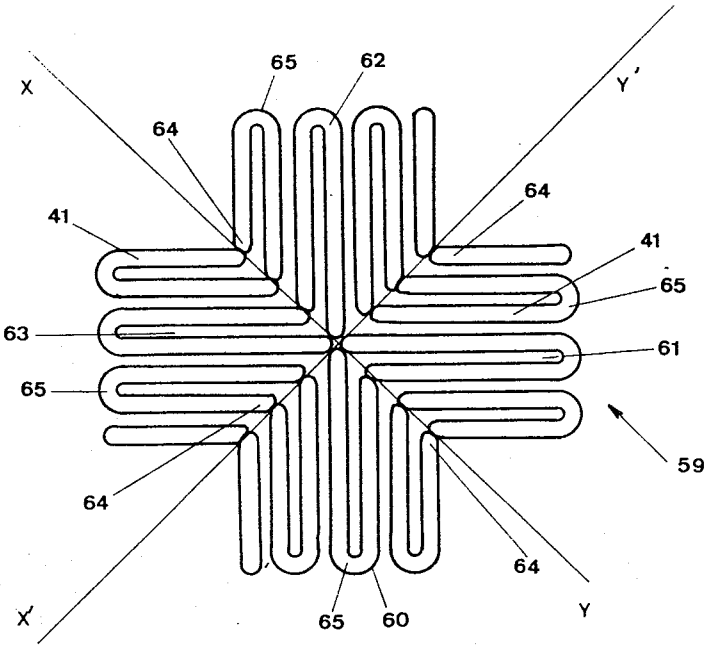
FIG. 8 is a partial view from above of a third embodiment of a straw fabric for a chair.

As seen in FIG. 8, the covering 51 is a third embodiment of a covering for a chair. The straw-bottom threads 41 are arranged onto the weft 40 so as to make four triangular portions 60, 61, 62 and 63. The threads of each said portions are arranged perpendicular with respect to the portions directly adjacent thereto.

As previously described, the straw-bottom threads 41 make loops 64, 65; the loops 65 define the lateral sides of the covering 59.

The straw-bottom threads 41 are joined together by pair a by forming loops along the two junction lines X-Y and X'-Y'. Said straw-bottom threads 41 join each other along the junction lines without crossing and overlaping.

Figure 9:
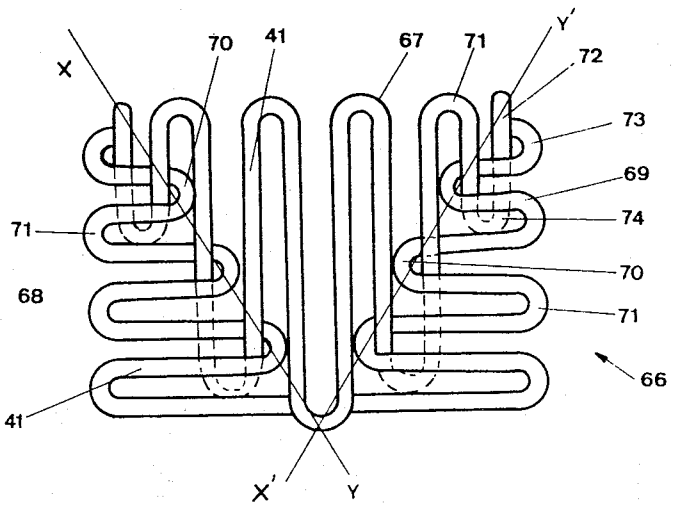
FIG. 9 is a partial view from above of a fourth embodiment of a straw fabric for a chair.

As shown in FIG. 9, the covering 66 constitutes a fourth embodiment of the covering for a chair. According to said embodiment, the straw-bottom threads 41 also define four portions separated from each other by the junction lines X-Y and X'-Y', as previously described. Only the portion 67 and two half-portions 68, 69 are shown in this Figure, and constitute half of the covering 66 to be made. The straw-bottom threads 41 forming each portion 67, 68, 69, are arranged perpendicular with respect to the threads 41 of the directly adjacent portions.

The threads 41 form the loops 70 at a level with the junction lines X-Y, X'-Y'; as well as at 71. The loops 71 form the lateral sides of the covering 66. According to this embodiment, the straw-bottom threads 41 join together perpendicular on a level with the junction lines X-Y and X'-Y'. By way of example, the thread 72 first passes beneath the weft and the thread 73, then returns by making a loop above said same thread 73, this performance being alternately achieved until the straw-bottom is made. The threads of the upper surface of the portion 67 thereby overlap the threads of the adjacent portion 68 or 69 perpendicularly prior to forming a loop 74 passing beneath the weft.

The straw-bottom is made in the form of a sheet which is fitted to the framework of a chair, a bench or, more generally, to any surface of furniture to be covered with same.

Of course, the invention is not limited to the examples or embodiments described hereabove and illustrated, from which other embodiment can be provided without thereby departing from the scope of the invention.

We claim:

1. A process for producing straw-bottomed chairs comprising the steps of weaving a piece of fabric from a straw-like material, simultaneously securing said straw-like material with threads of a non-straw-like material and then securing and tensioning said woven straw-like material secured by said non-straw-like material onto a support means to form the seat of a chair.

2. A process as claimed in claim 1 wherein said support means is comprised of a flat plate.

3. A process as claimed in claim 1 including the step of removing said threads of non-straw-like material after said piece of fabric is tensioned on said support means.

4. A process as claimed in claim 1 wherein said straw-like threads are woven by arranging each straw-like thread perpendicular to the previous straw-like thread such that the plurality of intersections between each straw-like thread and the straw-like thread immediately adjacent thereto form a spiral tracing.

5. A process as claimed in claim 1 including the step of securing said piece of fabric to a flexible support means.

6. A process for producing straw-bottomed chairs comprising steps of weaving a piece of fabric from a straw-like material by weaving threads of said straw-like material onto a preformed weft of non-straw-like material and then securing and tensioning said woven piece of fabric onto a support means to form the seat of a chair.

* * * * *